US005660392A

United States Patent [19]

Hansen

[11] Patent Number: 5,660,392

[45] Date of Patent: Aug. 26, 1997

[54] METHOD FOR PLAYING A BLACKJACK-TYPE OF CARD GAME

[75] Inventor: Brian S. Hansen, Golden, Colo.

[73] Assignee: Triad Games, LLC, Golden, Colo.

[21] Appl. No.: 671,144

[22] Filed: Jun. 24, 1996

[51] Int. Cl.[6] ..... A63F 1/00

[52] U.S. Cl. ..... 273/292; 273/274

[58] Field of Search ..... 273/292, 274, 273/309; 463/12

[56] References Cited

U.S. PATENT DOCUMENTS

| | | | |
|---|---|---|---|
| 4,659,087 | 4/1987 | Shen et al. | 273/274 |
| 5,257,789 | 11/1993 | LeVasseur | 273/309 |
| 5,257,810 | 11/1993 | Schorr et al. | 273/292 |
| 5,265,882 | 11/1993 | Malek | 273/292 |
| 5,275,416 | 1/1994 | Schorr et al. | 273/292 |
| 5,280,915 | 1/1994 | Groussman | 273/292 |
| 5,320,356 | 6/1994 | Cauda | 273/292 |
| 5,328,189 | 7/1994 | Malek | 273/292 |
| 5,368,305 | 11/1994 | Rodda et al. | 273/292 |
| 5,395,120 | 3/1995 | Malek | 273/292 |
| 5,397,128 | 3/1995 | Hesse et al. | 273/292 |
| 5,407,209 | 4/1995 | Prerost | 273/292 |
| 5,413,353 | 5/1995 | Demarest et al. | 273/292 |
| 5,437,462 | 8/1995 | Breeding | 273/292 |
| 5,494,296 | 2/1996 | Grassa | 273/292 |

*Primary Examiner*—Benjamin H. Layno

*Attorney, Agent, or Firm*—Townsend and Townsend and Crew LLP

[57] ABSTRACT

The invention provides a method for playing a blackjack-type of card game. According to one exemplary method, a player makes an initial wager. Then at one card is dealt to the player and the dealer. The player is then provided with the option of placing an additional wager. If the additional wager was placed, the player is dealt a second card. The player is then provided with the option of receiving additional cards provided that an additional wager is placed before each additional card can be received. After the player chooses not to place any more wagers, the player's cards and the dealer's cards are evaluated in the manner of conventional blackjack to determine a winner.

20 Claims, 2 Drawing Sheets

METHOD FOR PLAYING A BLACKJACK-TYPE OF CARD GAME

BACKGROUND OF THE INVENTION

The invention relates generally to the field of card games, and in particular to a blackjack-type of card game. More particularly, the invention relates to a blackjack-type of card game where the players are provided with an option to place multiple wagers during the game.

The game of "blackjack" or "twenty-one" is a popular type of card game and is played throughout the world. The game of blackjack typically begins by having each player place a wager. The dealer then deals the players and himself two cards. To win, the players' cards must have a total card value higher than that of the dealer, but no greater than twenty-one.

Hence, in blackjack each player plays against the dealer (or the "dealer's hand"), rather than against each player. The dealer's hand is played out by the dealer, usually in accordance with a set of pre-determined "house rules". These rules typically control the play of the dealer's hand with respect to when drawing subsequent cards. On the other hand, each player may play his or her hand out according to the individual player's choice. Hence, each player has the option to "hit" (draw a card) or "stand" (not draw a card) in the effort to reach twenty-one. Usually, each player is allowed to wager only a single bet, typically before receiving any cards.

Although the game of blackjack has gained wide acceptance, it would be desirable to provide certain improvements. For example, it would be desirable to provide modifications allowing the game to become more strategic, more exciting, and more interesting.

SUMMARY OF THE INVENTION

Accordingly, the present invention provides methods and apparatus for playing a blackjack-type of card game where additional wagers may be made throughout the game. In this way, the card game becomes more strategic as the player must determine the risk of wagering additional bets as each additional card is revealed. In turn, the game becomes much more exciting and interesting.

In an exemplary method, the invention provides for the playing of a blackjack-type of card game wherein at least one player plays against a dealer. According to the method, the player makes an initial wager and at least one card is dealt to the player and the dealer. The player is then provided with the option of placing an additional wager. If the player decides to place a wager, the player is then dealt another card. This process is repeated until the player chooses not to place a wager or breaks. Hence, the player may draw as many cards as needed or desired, with a bet being required before an additional card may be received. After the player chooses not to place anymore wagers, the player's cards and the dealer's cards are evaluated in the manner of conventional blackjack to determine a winner.

In one particular aspect, each of the dealer's cards will preferably be placed face up. On the other hand, the first card received by the player may be either face up or face down.

In another aspect, the player's initial wager is preferably limited by a table maximum amount. For example, if the table limit is $5.00, the player's initial bet may be no more than $5.00. The player's second wager will preferably at least match the player's initial wager, and more preferably will be an exact match of the player's initial wager. Any bets made subsequent to the player's second wager will preferably be twice the amount of the player's initial wager.

The method may further include other options such as providing the player the option of splitting cards of the same value to create an additional playing hand. When splitting cards, the player will preferably be required to match the initial wager. In another alternative, the player may be provided with the option of placing an insurance bet if the dealer's first card is an ace. Further, the game may be played with a single player or with a plurality of players which each play against the dealer.

The invention provides one particularly preferable method for playing blackjack where at least one player plays against a dealer. According to the method, the player makes an initial wager and a first card is dealt to the player and the dealer. The player is then provided with the option of receiving a second card provided an additional wager is placed. If such an additional wager is placed, a second card is dealt to the player. At this point, the player is provided with the option of receiving additional cards only if a wager is placed before receiving each additional card. Once the player chooses not to place a wager, no more cards are dealt to the player and the player's cards and the dealer's cards are evaluated (once the dealer has finished his play) in the manner of conventional blackjack to determine a winner. In a preferable aspect of the method, if the player chooses not to place an additional wager after receiving the first card, the player may chose to either surrender his hand or stand.

The invention further provides an apparatus for playing a blackjack-type of card game. The apparatus comprises a table having a playing surface. A dealer playing station is located at a first position on the playing surface. A plurality of player playing stations are located at spaced positions on the playing surface, with each player playing station having a defined region for receiving cards and a plurality of defined wagering locations located about the receiving region. The wagering locations are configured to receive sequential bets as each additional card is placed into the card receiving region.

In a preferable aspect, the defined card receiving regions are generally rectangular in geometry to correspond generally to the shape of the cards. The wagering locations are preferably circular in geometry and are disposed about two adjacent sides of the rectangular receiving region in an L-shape.

DETAILED DESCRIPTION OF THE SPECIFIC EMBODIMENTS

Referring now to the figures, an exemplary method and apparatus for playing a blackjack-type of card game will be described. The game will preferably employ a regular deck of fifty-two cards, preferably using four to six decks of cards. The game may be played by pitting a single player against the dealer, or alternatively by having a plurality of players each competing against the dealer. For convenience of discussion, the game will be described having only a single player competing against the dealer.

Figure 1:
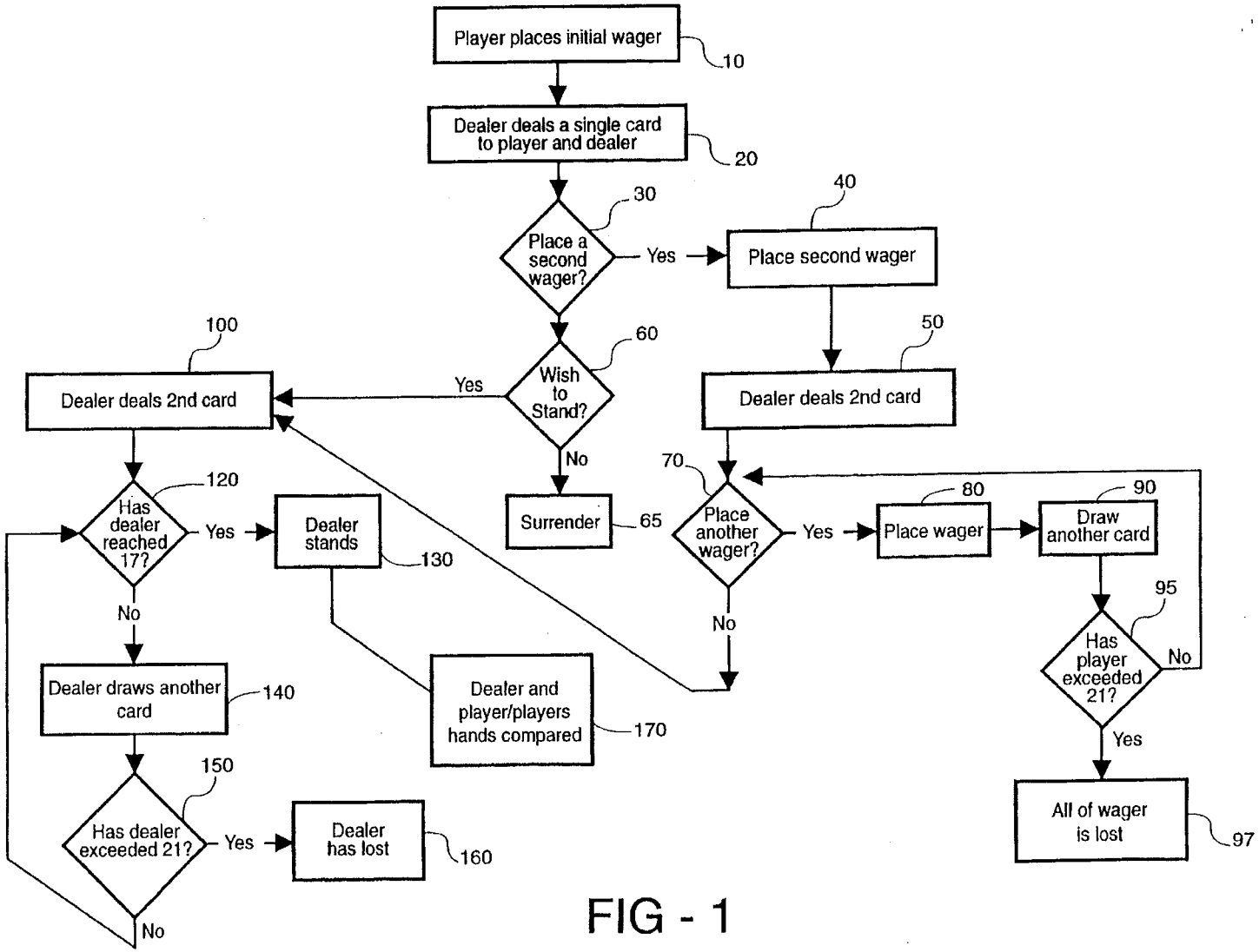
FIG. 1 is a flow chart illustrating an exemplary method for playing a blackjack-type of card game according to the present invention.

Referring now to FIG. 1, an exemplary method for playing a blackjack-type of card game will be described. To start the game, the player places an initial wager as illustrated in step 10. The player and dealer are then dealt a single card as illustrated in step 20. The player's first card may be dealt either face up or face down, while the dealer's first card, and any subsequent cards, will preferably be dealt face up, and preferably always last in rotation. All cards will preferably be dealt from a multiple deck shoe. It will be appreciated that the game may alternatively be modified to have the dealer deal the player two cards before providing the player with the opportunity of placing the second wager.

After receiving the first card, the player is given the option of placing a second wager as illustrated in step 30. If the player chooses to place an additional wager, the wager is placed as indicated in step 40 and the dealer deals the second card to the player as illustrated in step 50. If the player decides not to place a second wager in step 30, he can receive no additional cards and will then need to chose whether to stand as illustrated in step 60, or whether to surrender as illustrated in step 65. For example, when a dealer shows an ace or a ten as the up card, a player may not chose to make an additional wager and may chose to stand or surrender. To surrender, the player must announce "surrender" to the dealer. The dealer will then preferably place the player's cards face down and turn the cards at a 45° angle. This will signify a surrendered hand. In the event that the dealer makes blackjack, the player will lose their full initial wager. However, if the dealer does not make blackjack, the player will lose only half of their original wager.

If the player chooses to place the second wager and receives the second card as illustrated in step 50, the player is provided with the option of receiving additional cards on the condition that a wager is placed before receiving each additional card. This is illustrated in steps 70, 80 and 90. Hence, the player may receive as many cards as needed or desired as long as a wager is placed before receiving each additional card. However, as illustrated in steps 95 and 97, if the player ever exceeds twenty-one, the game ends and all of the player's wagers are lost. If the player's cards do not exceed twenty-one and the player chooses not to make any more wagers, the dealer then continues his play as described in greater detail hereinafter.

The wagers placed by the player will preferably be governed by a betting structure. Preferably, the player's initial wager (see step 10) will be limited by a table maximum wager. For example, if the table maximum were $5.00 the player's initial wager would be limited to $5.00. Preferably, a minimum amount will also be required so that the player's initial wager must be from, for example, $1.00 to $5.00. For the second wager (see step 30) the bet must preferably at least match the player's initial wager. More preferably, the player's second wager will exactly match the player's initial wager. For the third or any additional wagers (see step 70), such wagers will preferably be twice the amount of the player's initial wager.

As illustrated in step 110, the dealer will draw cards after all players have acted on their hands. As in conventional blackjack, the dealer must draw to sixteen and stand on seventeen. Alternatively, the dealer may draw to a soft seventeen. As illustrated in step 120, if the dealer is required to stand on seventeen, the dealer must determine if he has reached seventeen. If so, the dealer stands as illustrated in step 130. If not, the dealer must draw another card as illustrated in step 140. After each card is drawn, it is determined whether the dealer has exceeded twenty-one as illustrated in step 150. If the dealer exceeds twenty-one, the dealer loses as illustrated in step 160.

Once the dealer stands, the dealer's hand is compared with that of the players as illustrated in step 170. The winner is determined as in conventional blackjack, i.e. the player wins if the value of the player's cards exceeds that of the dealer's and the value of the player's cards does not exceed twenty-one. The player's hands are preferably played and collected by the dealer in a right to left manner. All cards are preferably picked up from the layout last in a right to left manner, before the next hand is dealt.

The above described card game may alternatively be provided with a variety of options as described hereinafter. For example, a player may optionally be allowed to make an insurance bet if the dealer's first up card is an ace. In this case, a player may wager up to one-half of the initial bet. If the dealer then makes blackjack, all insurance bets will preferably be paid out at least 2:1. However, the original bet is lost. All insurance bets will preferably be required to be placed before any second cards are dealt. All insurance payoffs will preferably be determined after the dealer receives his second card, in rotation.

The card game also provides another option in the event the player makes blackjack. In this alternative, if a player receives a ten value card or an ace for their first card of the hand, the player may wish to continue playing and match the initial bet. If the player then makes blackjack (and the dealer does not show an ace or a ten) the player would preferably be paid 3:2 for the two combined bets, or a maximum of $7.50 (assuming a betting maximum of $2.50). If the dealer draws to an ace or a ten and makes blackjack, the player will only lose the initial first bet, even if several additional bets and split bets (as described hereinafter) have been made.

In still a further option, a wager will be deemed to be void and returned to the player when the sum of the player's cards is the same as the dealer's. This is preferably the case even when the player and the dealer have blackjack and no insurance was taken.

As previously described, another option is the option to surrender. A player is allowed to surrender after seeing his or her first card and the dealer's first card, but before the player makes any additional wagers or receives any additional cards.

In still another option, the player may choose to split cards of the same value to create an additional playing hand. To do so, the player will preferably be required to place a match of the initial bet with the split hand. The split hand will preferably be played using the same method previously set forth in FIG. 1, and a player may preferably split same value cards a maximum of three times to create four playing hands. However, when a player receives an ace, the ace will preferably only be allowed to be split once and will only be able to receive one card per split. Hence, only a maximum of two bets per hand could be made, e.g., the two initial bets for the split and the one match bet for each second card.

In still yet another option, the player may choose to break hands. In this case, the dealer will preferably turn all player breaking hands face down on the layout, when aces or tens are showing. If the dealer draws blackjack, only the original bet will be lost by the player, even after several bets have been made.

Figure 2:
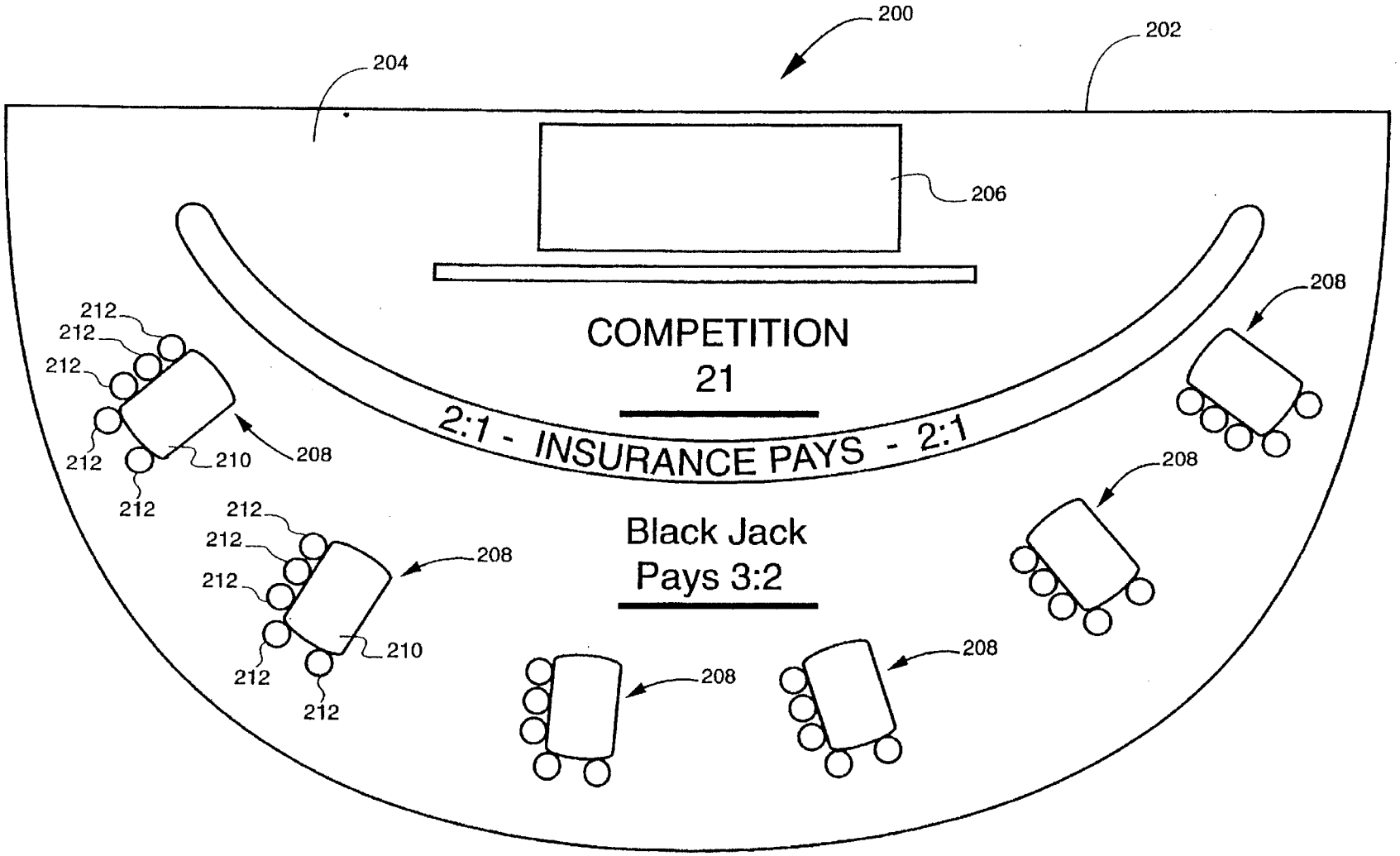
FIG. 2 is a top view of an exemplary card table incorporating a blackjack-type of card game in accordance with the principles of the present invention.

Referring now to FIG. 2, an exemplary apparatus 200 for playing the blackjack-type of card game previously described in connection with FIG. 1 will be described. Apparatus 200 comprises a table 202 having a playing surface 204. On one side of table 202 is a dealer playing station 206. On an opposite side of table 202 are a plurality of player playing stations 208. Each player playing station 208 comprises a card receiving region 210 and a plurality of wagering locations 212 which are distributed about the card receiving region 210. The card receiving regions 210 are preferably rectangular in geometry so that each player's cards may be placed therein. The wagering locations 212 are preferably circular in geometry and may optionally be sequentially numbered. As previously described in connection with the method of FIG. 1, each time an additional card is received a wager is placed into a separate wagering location. In one preferable aspect, the wagering locations 212 will be configured in an L-shape around card receiving region 210 as shown.

Optionally, payout rules may be lettered on playing surface 204 as shown. For example, the amount of payout for insurance or blackjack may be written thereon.

Although the foregoing invention has been described in some detail by way of illustration and example, for purposes of clarity of understanding, it will be obvious that certain changes and modifications may be practiced within the scope of the appended claims.

What is claimed is:

1. A method for playing blackjack wherein at least one player plays against a dealer, the method comprising:

a) the player making an initial wager;

b) dealing at least one card to the player and the dealer;

c) providing the player with the option of placing an additional wager;

d) dealing another card to the player if a wager was placed in step c;

e) repeating steps c and d until the player chooses not to place a wager; and f) evaluating the player's cards and the dealer's cards in the manner of conventional blackjack and determining a winner.

2. A method as in claim 1, wherein said at least one card is dealt to the dealer face up.

3. A method as in claim 1, wherein said at least one card is dealt to the player face up or face down.

4. A method as in claim 1, wherein the player's initial wager is limited by a table maximum amount.

5. A method as in claim 4, wherein the player's second wager must at least match the player's initial wager.

6. A method as in claim 5 wherein any wagers made after the player's second wager must be twice the amount of the player's initial wager.

7. A method as in claim 1, further comprising providing the player with the option of splitting cards of the same value to create an additional playing hand.

8. A method as in claim 7, further comprising requiring the player to match the initial wager when splitting cards.

9. A method as in claim 1, further comprising the player placing an insurance bet if the dealer's first card is an ace.

10. A method as in claim 1, wherein a plurality of players play against the dealer.

11. A method for playing blackjack wherein at least one player plays against a dealer, the method comprising:

a) the player making an initial wager;

b) dealing a first card to the player and the dealer;

c) providing the player with the option of receiving a second card if an additional wager is placed;

d) dealing a second card to the player if a wager was made in connection with step c;

e) providing the player with the option of receiving an additional card if an additional wager is placed in connection with receiving the additional card;

f) repeating step e until the player chooses not to place a wager; and g) evaluating the player's cards and the dealer's cards in the manner of conventional blackjack and determining a winner.

12. A method as in claim 11, further comprising surrendering the player's hand if the player chooses not to place an additional wager after receiving the first card.

13. A method as in claim 11, wherein each of the dealer's cards are placed face up.

14. A method as in claim 11, wherein the player's first card is placed either face up or face down.

15. A method as in claim 11, wherein the player's initial wager is limited by a betting minimum and a betting maximum amount.

16. A method as in claim 15, wherein the player's second wager must match the player's initial wager.

17. A method as in claim 16, wherein any wagers made after the player's second wager must be twice the amount of the player's initial wager.

18. A method as in claim 11, further comprising providing the player with the option of splitting cards of the same value to create an additional playing hand.

19. A method as in claim 11, further comprising the player placing an insurance bet if the dealer's first card is an ace.

20. A method as in claim 11, wherein a plurality of players play against the dealer.

* * * * *